US009702647B2

(12) United States Patent
Head

(10) Patent No.: US 9,702,647 B2
(45) Date of Patent: Jul. 11, 2017

(54) SPEED LOADERS FOR LOADING CARTRIDGES IN REVOLVER CYLINDERS

(71) Applicant: Vulcan Ballistic Products, LLC, Greenville, SC (US)

(72) Inventor: Thomas S. Head, Greenville, SC (US)

(73) Assignee: Vulcan Ballistic Products, LLC, Greenville, SC (US)

( * ) Notice: Subject to any disclaimer, the term of this patent is extended or adjusted under 35 U.S.C. 154(b) by 0 days.

(21) Appl. No.: 14/925,177

(22) Filed: Oct. 28, 2015

(65) Prior Publication Data

US 2017/0122683 A1 May 4, 2017

(51) Int. Cl.
*F41A 9/61* (2006.01)
*F41A 9/85* (2006.01)
*F41C 3/14* (2006.01)

(52) U.S. Cl.
CPC . *F41A 9/85* (2013.01); *F41C 3/14* (2013.01)

(58) Field of Classification Search
CPC ..... F41A 9/85; F41C 3/14
See application file for complete search history.

(56) References Cited

U.S. PATENT DOCUMENTS 1,655,624 A * 1/1928 Nelson ..... F41A 9/85 42/89
1,964,171 A * 6/1934 Pflaume ..... F41A 9/85 42/89
2,406,232 A * 8/1946 Lima ..... F41A 9/85 184/82
3,140,459 A 7/1964 Schoick
3,150,459 A * 9/1964 Schoick ..... F41A 9/85 42/89
3,252,238 A * 5/1966 Bye ..... F41A 9/85 42/89
3,503,150 A * 3/1970 Bye ..... F41A 9/85 42/89
3,541,716 A * 11/1970 Fordham ..... F41A 9/85 42/89
3,955,301 A 5/1976 Wiethoff
4,030,222 A 6/1977 Sommer
4,065,868 A 1/1978 Johnson
4,079,536 A * 3/1978 Hunt ..... F41A 9/85 42/89
4,133,129 A 1/1979 Jelinek et al.
4,202,124 A * 5/1980 Switzer ..... F41A 9/85 42/89

(Continued)

OTHER PUBLICATIONS

Vulcan Ballistic Products, LLC, International Patent Application No. PCT/US2016/054701; International Search Report dated Dec. 8, 2016; (5 pages).

(Continued)

*Primary Examiner* — Michelle R Clement
(74) *Attorney, Agent, or Firm* — Dority & Manning, P.A.

(57) ABSTRACT

Speed loaders for loading cartridges revolver cylinders are provided. A speed loader includes a main body which is configured to accommodate a plurality of cartridges therein. The speed loader further includes a plunger movable along a longitudinal axis between a first position and a second position. Movement of the plunger from the first position to the second position causes ejection of the plurality of cartridges from the main body.

19 Claims, 4 Drawing Sheets

(56) References Cited

U.S. PATENT DOCUMENTS

| | | | | | |
|---|---|---|---|---|---|
| 4,229,896 | A | * | 10/1980 | Jurich, III | F41A 9/85 42/89 |
| 4,254,571 | A | | 3/1981 | Peter et al. | |
| 4,272,903 | A | * | 6/1981 | Griffis | F42B 39/02 42/89 |
| 4,313,275 | A | | 2/1982 | Switzer | |
| 4,325,198 | A | | 4/1982 | Muck et al. | |
| 4,402,153 | A | | 9/1983 | Peter et al. | |
| 4,437,252 | A | | 3/1984 | Castellanos Manero | |
| 4,507,889 | A | * | 4/1985 | Allen | F41A 9/85 42/89 |
| 4,509,284 | A | | 4/1985 | Naber | |
| 4,535,558 | A | | 8/1985 | Benesh | |
| 4,697,369 | A | | 10/1987 | Spears | |
| 4,756,110 | A | | 7/1988 | Beltron | |
| 4,796,371 | A | * | 1/1989 | Daniels | F41A 9/85 42/89 |
| 4,862,622 | A | | 9/1989 | Goyanes | |
| 4,866,870 | A | * | 9/1989 | Johnson | F41A 9/85 42/89 |
| 4,869,009 | A | | 9/1989 | Bennett | |
| 5,548,916 | A | | 8/1996 | Kinsel | |
| 5,621,998 | A | | 4/1997 | Norgaard | |
| 5,842,299 | A | | 12/1998 | Switzer et al. | |
| 5,953,845 | A | * | 9/1999 | Longwitz | F41A 9/85 42/89 |
| 6,308,451 | B1 | | 10/2001 | Koledey | |
| 7,363,845 | B2 | | 4/2008 | McClellan | |
| 8,136,285 | B2 | | 3/2012 | Abell et al. | |
| 8,931,633 | B2 | | 1/2015 | Martin, III | |

OTHER PUBLICATIONS

Speedbeez, Intrnet Website; http://www.speedbeez.com/ printed Oct. 29, 2015; 3 pages.

* cited by examiner

SPEED LOADERS FOR LOADING CARTRIDGES IN REVOLVER CYLINDERS

FIELD OF THE INVENTION

The present disclosure relates generally to speed loaders for loading cartridges into the cylinders of revolvers.

BACKGROUND OF THE INVENTION

Various types of loaders are known for loading cartridges into various types of firearms. For example, loaders may be utilized to load cartridges into the cylinders of revolvers. A revolver typically includes a cylinder which has multiple chambers (typically five or six chambers), each of which is configured to accept a bullet cartridge therein for firing of the bullet from the revolver. As is generally understood, the cylinder rotates to align each chamber in turn with a barrel of the revolver. When a trigger is pulled, a hammer of the revolver strikes the cartridge loaded in the aligned cylinder, causing a propellant to ignite and fire a bullet from the cartridge.

A typical loader temporarily retains multiple loaded bullet cartridges for transfer to the cylinder when required. When reloading of the cylinder is required, the cartridges are generally simultaneously released from the loader into the chambers of the cylinder. Many known loaders, for example, include a rotational apparatus which, when twisted, releases the cartridges within the loader and allows them to fall into the cylinder. However, such release apparatus is relatively complicated and can be cumbersome for a user of the loader. Additionally, known loaders do not adequately urge the cartridges from the loaders into the cylinders, instead relying mainly on gravity for such cartridge transfer. Further, in many cases, cartridges are held relatively rigidly within the loader, thus making alignment of the cartridges with the chambers of the cylinder difficult. Alternatively, some cartridges are held relatively loosely to aid in alignment, causing the loose cartridges to rattle in the loader.

Accordingly, improved loaders for loading cartridges in revolver cylinders are desired in the art.

BRIEF DESCRIPTION OF THE INVENTION

Aspects and advantages of the invention will be set forth in part in the following description, or may be obvious from the description, or may be learned through practice of the invention.

In accordance with one embodiment, a speed loader for loading cartridges in a revolver cylinder is provided. The speed loader includes a main body configured to accommodate a plurality of cartridges therein, and a plunger movable along a longitudinal axis between a first position and a second position. Movement of the plunger from the first position to the second position causes ejection of the plurality of cartridges from the main body.

In accordance with another embodiment, a speed loader for loading cartridges in a revolver cylinder is provided. The speed loader includes a main body which extends along a longitudinal axis between a first end and a second end. The main body defines a plurality of passages, each of the plurality of passages extending along the longitudinal axis between a first opening defined in the first end and a second opening defined in the second end. Each of the plurality of passages is configured to accommodate a cartridge therein. The speed loader further includes a plunger. The plunger includes a plurality of plunger arms, each of the plurality of plunger arms including a contact surface and extendable into one of the plurality of passages. The plunger is movable along the longitudinal axis between a first position and a second position, wherein in the first position each of the plurality of contact surfaces is proximate the first end relative to in the second position and in the second position each of the plurality of contact surfaces is distal from the first end relative to in the first position. Movement of the plunger from the first position to the second position causes ejection of cartridges accommodated within the plurality of passages from the plurality of passages.

In accordance with another embodiment, a speed loader for loading cartridges in a revolver cylinder is provided. The speed loader includes a main body which extends along a longitudinal axis between a first end and a second end. The main body is formed from an elastomer. The main body defines a plurality of passages, each of the plurality of passages extending along the longitudinal axis between a first opening defined in the first end and a second opening defined in the second end. Each of the plurality of passages includes a first section extending from the first end, a second section extending from the first section, and a third section extending from the second section, the second section having a width greater than a width of the first section and a width of the third section. The speed loader further includes a plunger. The plunger includes a plunger body and a plurality of plunger arms extending from the plunger body, each of the plurality of plunger arms extendable into one of the plurality of passages and including a shaft extending from the plunger body and a head extending from the shaft. The head has a width greater than a width of the shaft and a width of the first section of the passage into which the plunger arm is extendable. The plunger is movable along the longitudinal axis between a first position and a second position, wherein in the first position each of the plurality of heads is proximate the first end relative to in the second position and in the second position each of the plurality of heads is distal from the first end relative to in the second position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
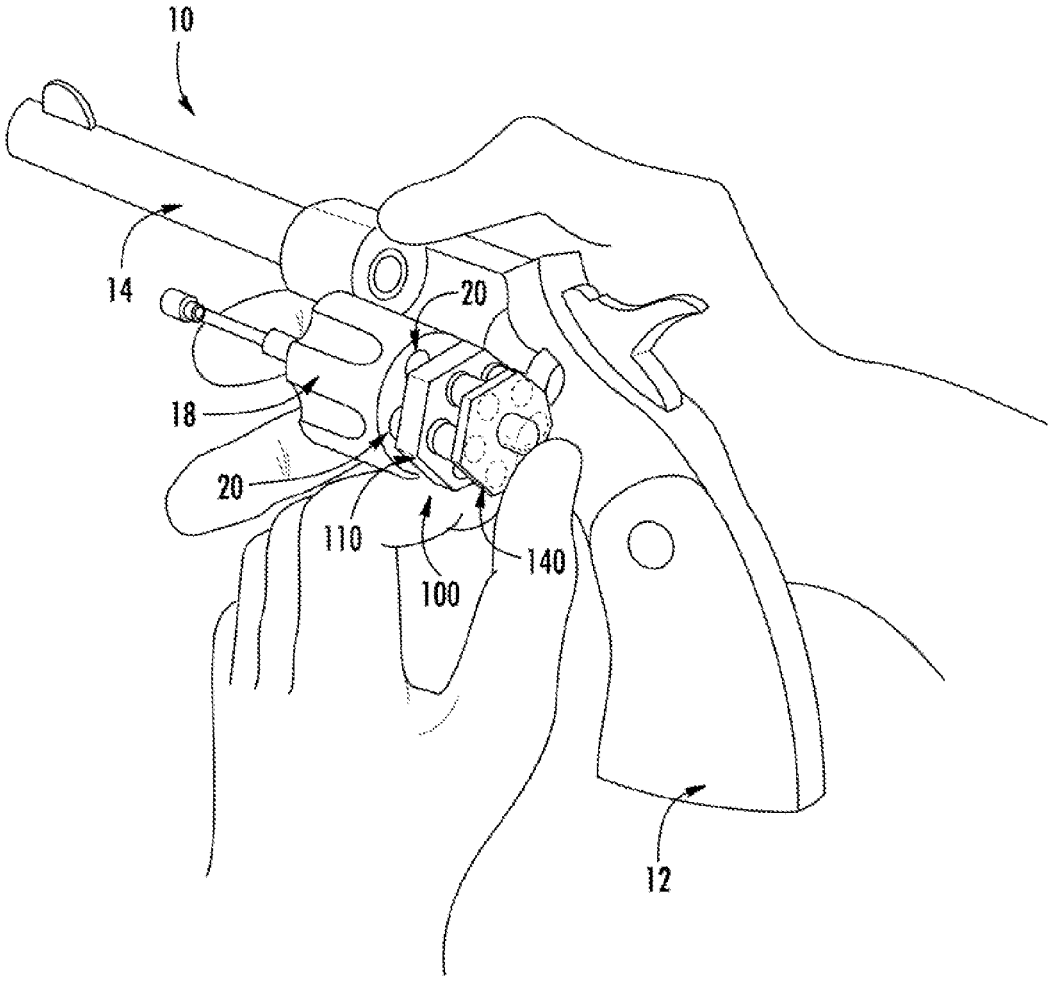
FIG. 1 is a perspective view of a speed loader being utilized to load cartridges into a firearm in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
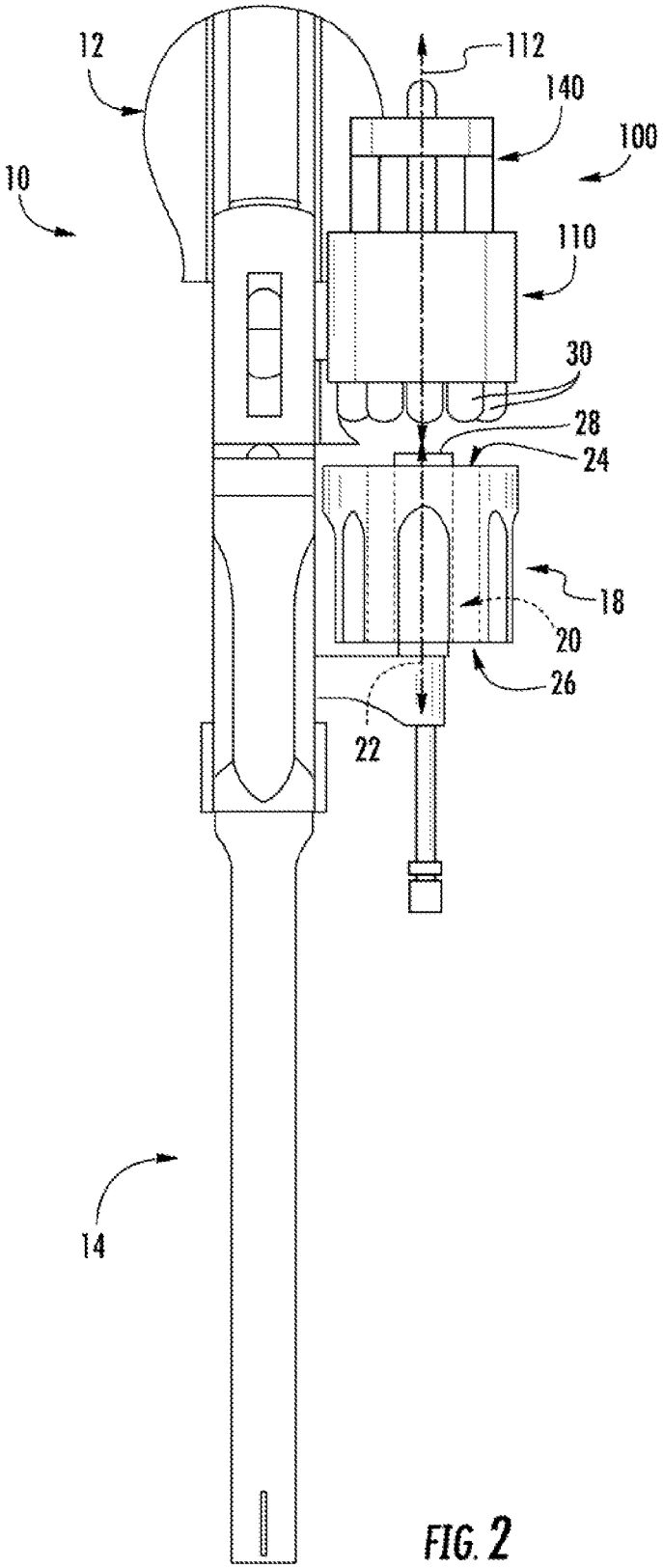
FIG. 2 is atop view of a speed loader being utilized to load cartridges into a firearm in accordance with one embodiment of the present disclosure.

Referring now to FIGS. 1 and 2, embodiments of a firearm 10 are illustrated. Firearm 10 may generally include a grip 12, a barrel 14, a trigger and a cylinder 18. The firearm 10 may conventionally be referred to as a revolver due to the rotational nature of the cylinder 18 about a longitudinal axis, as is generally understood. The cylinder 18 may include a plurality of chambers 20. The chambers 20 may each extend along a longitudinal axis 22 between a first end 24 and a second opposite end 26 of the cylinder 18, and may be disposed in an annular array about the longitudinal axis 22. In exemplary embodiments, five or six chambers 20 may be provided. Alternatively, any suitable number of chambers 20 may be utilized.

Each chamber 20 may be sized and shaped to accommodate therein a cartridge 30. The cartridge 30 may, for example, when initially loaded include a bullet and a propellant therein, as is generally understood. It should be understood that the present disclosure is not limited to any particular caliber cartridge, and rather that cartridges having any suitable caliber, i.e. .22, .38, .45, etc. may be utilized in accordance with the present disclosure. The chambers 20 may be sized and shaped to accommodate the particular caliber cartridge being utilized for a particular application.

Figure 3:
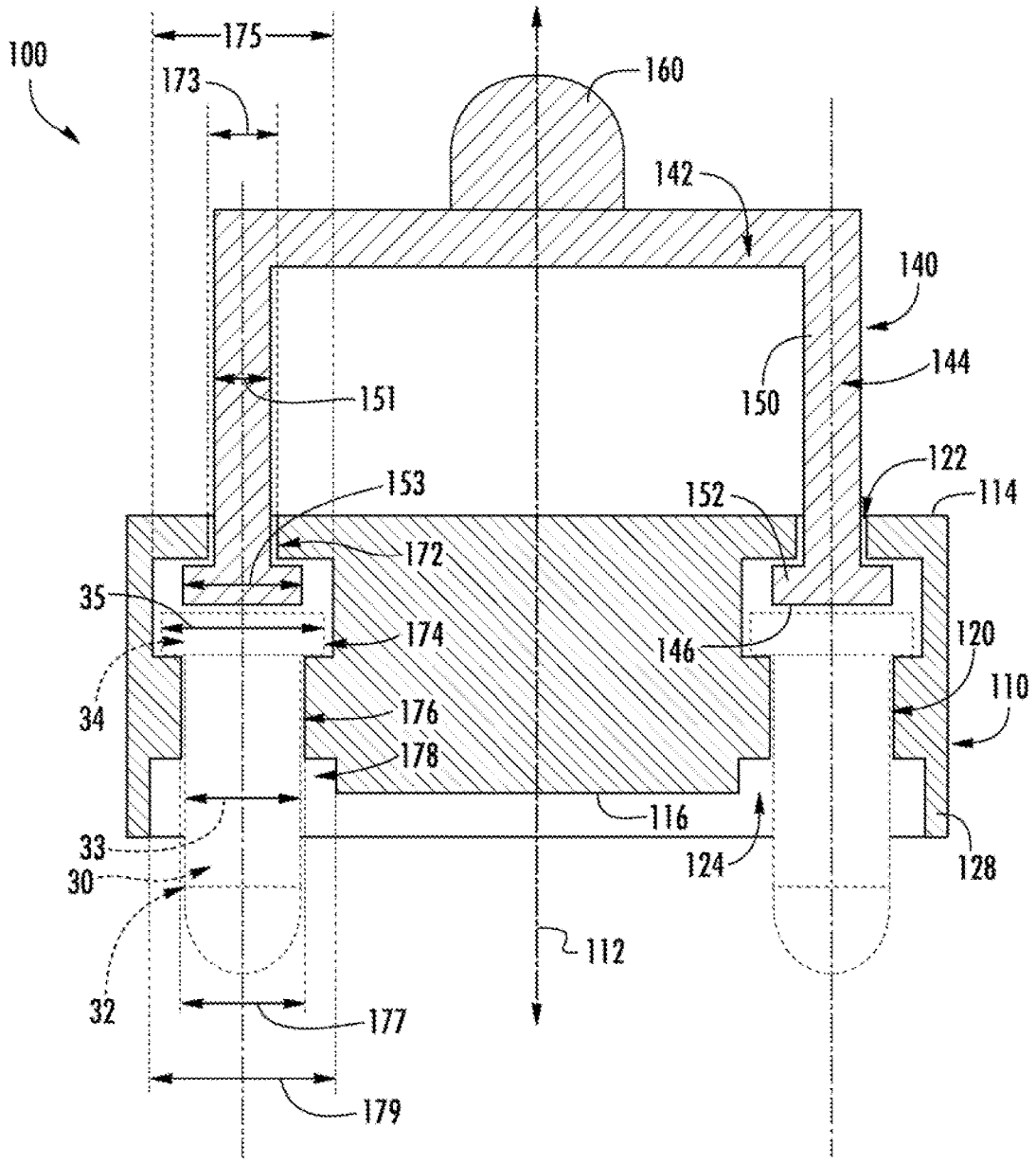
FIG. 3 is a cross-sectional view of a speed loader with a plunger in a first position in accordance with one embodiment of the present disclosure.
Figure 4:
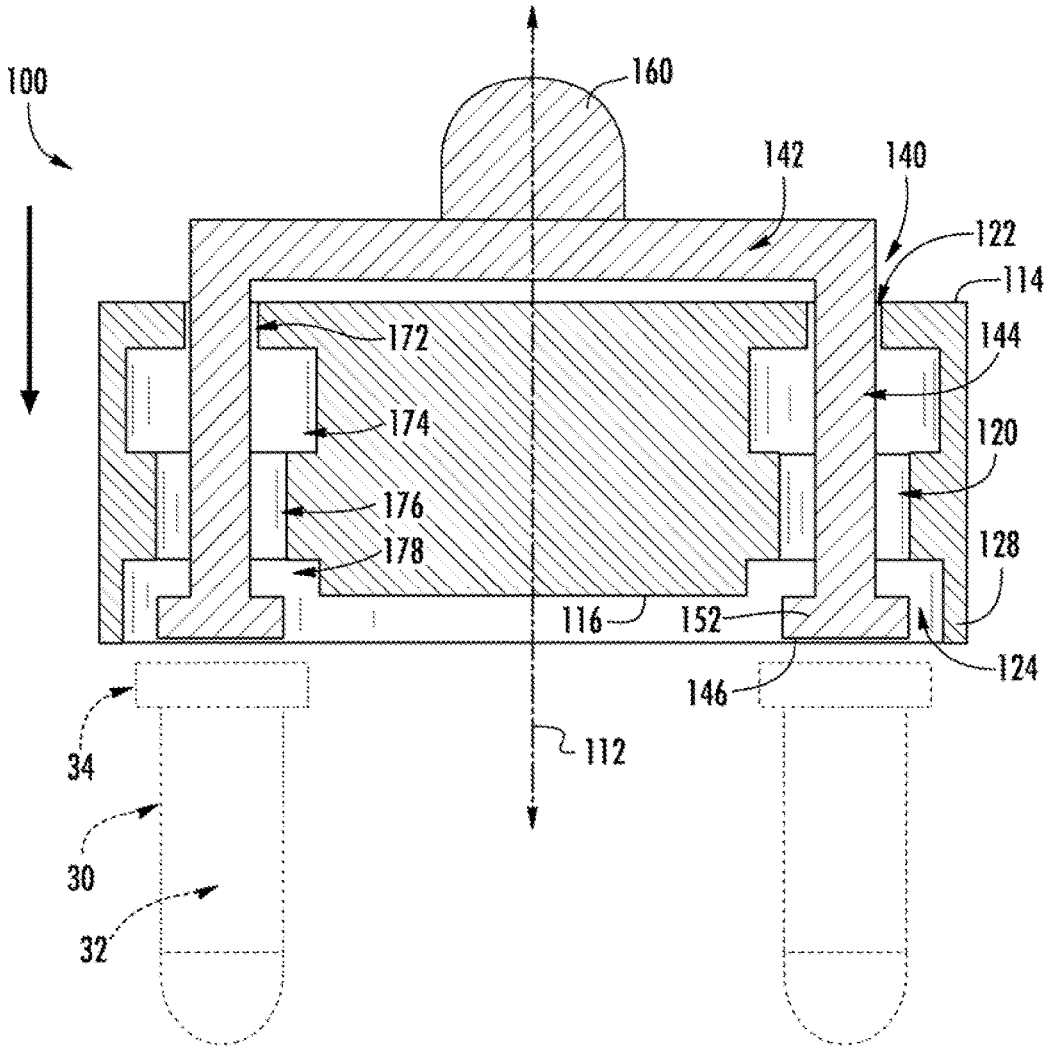
FIG. 4 is a cross-sectional view of a speed loader with a plunger in a second position in accordance with one embodiment of the present disclosure.

Referring still to FIGS. 1 and 2 as well as to FIGS. 3 and 4, embodiments of a speed loader 100 for loading cartridges 30 into a revolver cylinder 18 are provided. Speed loaders 100 in accordance with the present disclosure advantageously facilitate simple and efficient loading of cartridges 30 into the various chambers 20 of the cylinder 18. In particular, cartridges 30 loaded into the speed loader 100 may be ejected therefrom (and into chambers 20) due to a generally linear force that is applied by a user to the speed loader 100. Notably, no rotational movements or complex rotational-based apparatus are required. In exemplary embodiments, for example, a speed loader 100 in accordance with the present disclosure requires only two components: a main body and a plunger. The main body retains the cartridges 30, and the plunger interacts with the cartridges to eject them from the main body 30, as discussed herein. Additionally, speed loaders 100 in accordance with the present disclosure facilitate improved alignment of the cartridges 30 with the chambers 20 of a cylinder 18 by not rigidly holding the cartridges 30 therein, thus allowing movement of the cartridges 30 within the speed loader 100 to facilitate such alignment. Further, audible rattling of the cartridges 30 within speed loaders 100 in accordance with the present disclosure may in exemplary embodiments be reduced due to the materials utilized to form components of the speed loaders 100, such as elastomers.

A speed loader 100 may include a main body 110 which extends along a longitudinal axis 112 between a first end 114 and a second end 116. In exemplary embodiments, the main body 110 may have a hexagonal or pentagonal cross-sectional shape or may be cylindrical, although other suitable shapes are within the scope and spirit of the present disclosure. A hexagonal cross-sectional shape, for example, may be utilized in embodiments wherein the speed loader 100 facilitates loading of six cartridges. Similarly, a pentagonal cross-sectional shape may be utilized in embodiments wherein the speed loader 100 facilitates loading of five cartridges. These shapes may provide clearance between the speed loader 100 and firearm 10. During operation of the speed loader 100 to eject cartridges 30 into the chambers 20 of a cylinder 18, the longitudinal axis 112 may be approximately aligned, and thus parallel to and in exemplary embodiments co-axial with, longitudinal axis 22.

A plurality of passages 120 may be defined in the main body 110. Each passage 120 may extend along the longitudinal axis 112 between the first end 114 and the second end 116, such that a first opening 122 of each passage 120 is defined in the first end 114 and a second opening 124 of each passage 120 is defined in the second end 116. In exemplary embodiments as shown, each passage 120 is parallel to the longitudinal axis 112, such that an individual longitudinal axis extending through each passage 120 is parallel to the longitudinal axis 112. Further, in exemplary embodiments, the passages 120 may be disposed in an annular array about the longitudinal axis 112. In exemplary embodiments, five or six passages 120 may be provided. Alternatively, any suitable number of passages 120 may be utilized.

The number of passages 120 may in exemplary embodiments be generally identical to the number of chambers 20 of a cylinder 18 with which the speed loader 100 is to be utilized. Further, the spacing of the passages 120 may be generally identical to the spacing of the chambers 20, to facilitate the alignment of passages 120 with chambers 20 in order to eject cartridges 30 from the passages 120 into the chambers 20.

Each passage 120 may be configured to accommodate a cartridge 30 therein. For example, each passage 120 may be sized and shaped such that a cartridge 30 can be inserted into the passage 120, i.e. through the second opening 124 thereof. The cartridge 30 may then, for example, remain housed at least partially within the passage 120 (a tip of the cartridge 30 may for example, extend from the passage 120 through the second opening 124) until ejected therefrom as discussed herein. Notably, the passages 120 may be sized and shaped to accommodate the particular caliber cartridge being utilized for a particular application.

In exemplary embodiments, the main body 110 is formed from an elastomer or other suitable elastic material. As discussed further herein, use of such materials may advantageously allow the cartridges 30 to be housed in the passages 120 and then ejected from the passages 120 due to, for example, a linear force along the longitudinal axis 112. In exemplary embodiments, for example, the material that forms the main body 110, such as the elastomer or other suitable elastic material, may have a Type A Shore hardness of between 70 and 90, such as between 75 and 85, such as between 78 and 82, such as 80. Notably, use of such materials reduces any audible rattle of the cartridges 30 when housed in the main body 110.

Main body 110 may further include a peripheral lip 128 which extends from the second end 116 thereof. The peripheral lip 128 may generally extend from a periphery of the second end 116, and may for example surround the second openings 124. The lip 128 may, for example, contact the cylinder 18, such as a first face of the cylinder 18 in which the first ends 24 of the chambers 20 are defined, for ejecting of cartridges 30 into the chambers 20. Advantageously, the lip 128 may provide a clearance between the second end 116 and an ejector protrusion (conventionally referred to as an ejector star) 28 extending from the first end 24 of the cylinder 18 of the firearm 10. Alternatively, no lip 128 may be utilized and the second end 116 of the main body 110 may contact the first face, or the main body 110 may be spaced from the cylinder 18 during loading of the cartridges 30 into the chambers 20.

A speed loader 100 in accordance with the present disclosure may further include a plunger 140. The plunger 140 may generally be movable linearly, such as along longitudinal axis 112, to eject cartridges 30 from the main body 110 for loading into chambers 20. For example, as discussed herein, a user may apply a force to the plunger 140 to move the plunger 140 in a linear direction relative to the main body 110. Such force may cause the plunger 140 to contact and move the cartridges 30 in linear directions, such as along the longitudinal axis 112, through the passages 120 until they are ejected from the second openings 124 of the passages 120. Notably and advantageously, no rotational forces or actuations are required for release and ejection of the cartridges 30.

As illustrated, plunger 140 may include a plurality of plunger arms 144 which may, for example, each extend from a plunger body 142. Each arm 144 may extend from the body 142 and be extendable into one of the plurality of passages 120 of the main body 110. When the plunger 140 is aligned with the body 110 and portions of the arms 144 are disposed within the passages 120, the arms 144 may for example be parallel to the longitudinal axis 112. In exemplary embodiments, the number of arms 144 utilized with plunger 140 may be identical to the number of passages 120.

Each arm 144 may extend into one of the plurality of passages 120 through the first opening 122 thereof, and may be movable along the longitudinal axis 112 within the associated passage 120. For example, each arm 144 may include a contact surface 146, which may be a surface of the arm 144 that contacts a cartridge 30 within an associated passage 120 to move the cartridge 30 through the passage 120 for ejection therefrom. In exemplary embodiments, a contact surface 146 may be the distal-most surface of an arm 144 relative to the plunger body 142 from which the arm 144, such that the arm 144 extends between the plunger body 142 and the contact surface 146. As illustrated in FIGS. 3 and 4, plunger 140 may be movable along the longitudinal axis 112 between a first position (FIG. 3) and a second position (FIG. 4). In the first position, each of the plurality of contact surfaces 146 may be disposed within a respective passage 120 and proximate the first end 114 of the main body 110 (and first opening 122 of the passage 120) relative to when in the second position. In the second position, each of the plurality of contact surfaces 146 may be disposed within or exterior to the respective passage 120 and distal from the first end 114 of the main body 110 (and first opening 122 of the passage 120) relative to when in the first position. Accordingly, when in the first position relatively less of each arm 144 may be disposed within the associated passage 120 and when in the second position relatively more of each arm 144 may be disposed within the associated passage 120. Each contact surface 146 may, for example, be proximate the first end 114 (and first opening 122) relative to the second end 116 (and second opening 124) in the first position and proximate the second end 116 (and second opening 124) relative to the first end 114 (and first opening 122) in the second position. As each arm 144 moves from the first position to the second position, the contact surface 146 of each arm 144 may contact a cartridge 30 disposed in the associated passage 120. The arm 144 and contact surface 146 may push the cartridge 30 along the longitudinal axis 112 through the passage 120 such that the cartridge 30 is ejected from the passage 120 through the second opening 124 thereof. When the main body 110 is aligned with the cylinder 18, cartridges 30 ejected therefrom may enter the chambers 20 of the cylinder 18, such that the cartridges 30 are loaded into the cylinder 18.

Notably, such movement of the plunger 140 relative to the main body 110 may be caused by a user applying a force to the plunger 140.

In exemplary embodiments, each arm 144 may include a shaft 150 and a head 152. The shaft 150 may, for example, extend from the plunger body 142. The head 152 may extend from the shaft 150, and thus be spaced from the plunger body 142 by the shaft 150. The head 152 may further include the contact surface 146 of that arm 144. As illustrated, the head 152 of an arm 144 may have a width 153 (which may for example be a diameter and which may be a maximum width/diameter) that is greater than a width 151 (which may for example be a diameter and which may be a maximum width/diameter) of the shaft 150. Alternatively, an arm 144 may for example just include a shaft 150, with the contact surface 146 of the arm 144 included on the shaft 150.

Plunger 140 may in some embodiments further include a grip 160. The grip 160 may protrude and thus extend from the plunger body 142, such as in a direction opposite from the plunger arms 144. For example, arms 144 may extend from a face of the plunger body 142, and grip 160 may extend from an opposing face of the plunger body 142. Grip 160 may allow a user to easily grasp the plunger 140, and to apply a force to the plunger 140. For example, the user may apply a force to the plunger 142 by contacting the grip 160 (i.e. with a thumb, finger, etc.) and pressing the grip 160 in a direction towards the main body 110, such as along the longitudinal axis 112.

FIGS. 3 and 4 further illustrate embodiments of various sections of passages 120 of speed loaders 100. The varying sizes of such sections relative to each other may facilitate the accommodation of cartridges 30 by the passage 120 and subsequent ejection of the cartridges from the passages 120. For example, each passage 120 may include a first section 172 which extends (such as along the longitudinal axis 112) from the first end 114 and includes the first opening 122. A second section 174 may extend (such as along the longitudinal axis 112) from the first section 172, and a third section 176 may extend (such as along the longitudinal axis 112) from the second section 174.

In exemplary embodiments, a width 175 (which may for example be a diameter and which may be a maximum width/diameter, and which is measured in an undeformed state) of the second section 174 may be greater than a width 173 (which may for example be a diameter and which may be a maximum width/diameter, and which is measured in an undeformed state) of the first section 172. Additionally, the width 153 of the head 152 may be greater than the width 173 of the first section 172 (and less than the width 175 of the second section 174). Accordingly, once a head 152 is disposed within the second section 174, it may abut against a portion of the main body 110 defining the second section 174, making removal through the first section 172 difficult. As discussed, the main body 110 may be formed from an elastic material. Accordingly, the main body 110 may deform to allow the head 152 through the first section 172 when extending the plunger arm 144 into the passage 120, and may further deform to allow the head 152 to exit the passage through the first section 172, when sufficient force is applied to the plunger 140 (such as along the longitudinal axis 112).

In further exemplary embodiments, width 175 of the second section 174 may be greater than a width 177 (which may for example be a diameter and which may be a maximum width/diameter, and which is measured in an undeformed state) of the third section 176. Additionally, in exemplary embodiments, the width 177 of the third section 176 may be greater than the width 173 of the first section 172. Further, in exemplary embodiments, the width 177 of the third section 176 may be greater than the width 153 of the head 152. The second and third sections 174, 176 may be sized and shaped to accommodate cartridges 30 initially disposed within the passages 120 and to facilitate ejection of the cartridges 30 from the passages 120. For example, as illustrated, a cartridge 30 may include a body 32 and a rim 34. The rim 34 may have a width 35 (which may for example be a diameter and which may be a maximum width/diameter), which may in some embodiments be greater than a width 33 (which may for example be a diameter and which may be a maximum width/diameter) of the body 32. The width 177 of the third section 176 may be less than the width 35 of the rim 34, and the width 175 of the second section 174 may be greater than the width 35 of the rim 34. Accordingly, when a cartridge 30 is loaded into a passage 120, the rim 34 may abut against a portion of the main body 110 defining the second section 174 and cause the cartridge 30 to hang from the second section 174 into and through third section 176. When the plunger arm 144 contacts the cartridge 30 during movement from the first position to the second position, this movement may cause the third section 176 to deform and the cartridge 30 (and rim 34 thereof) to pass through the third section 176 for ejection from the passage 120.

Additionally, in exemplary embodiments, the width 177 of the third section 176 may be greater than the width 33 of the body 32. This may allow the body 32 to move within the passage 120, to facilitate alignment of the cartridge 30 with a cylinder 18 of a chamber 20 into which the cartridge 30 is loaded.

Further, a passage 120 may include a fourth section 178, which may have a width 179 (which may for example be a diameter and which may be a maximum width/diameter, and which is measured in an undeformed state). The fourth section 178 may extend from the third section 176, and may in some embodiments extend to the second end 116 (and thus include the second opening 124 of the passage 120). The width 179 of the fourth section 178 may be greater than the width 177 of the third section 176. Further, the width 179 of the fourth section 178 may in some embodiments be equal to the width 175 of the second section 174. Width 179 may additionally be sized to be greater than the width 35 of the rim 34. Accordingly, when a cartridge 30 is being pushed through the passage 120 for ejection therefrom, it may be released from the passage 120 when the rim 34 enters the fourth section 178 from the third section 176. The rim 34 may no longer be slid against the surface of the main body 110 that defines the third section 176, and may thus for example be free to move (via gravity or further force from the plunger arm 144) from the passage 120. Notably, the widths 177, 179 of the third and fourth sections 176, 178 relative to the rim 34 may advantageously provide the user with a tactile response that can be felt when the cartridge 30 is released from the third section 176 into the fourth section 178 due to the reduction in friction between the rim 34 and the main body 110.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A speed loader for loading cartridges in a revolver cylinder, the speed loader comprising:

a main body extending along a longitudinal axis between a first end and a second end, the main body defining a plurality of passages, each of the plurality of passages extending along the longitudinal axis between a first opening defined in the first end and a second opening defined in the second end, each of the plurality of passages configured to accommodate a cartridge therein; and a plunger, the plunger comprising a plurality of plunger arms, each of the plurality of plunger arms comprising a contact surface and extendable into one of the plurality of passages, the plunger movable along the longitudinal axis between a first position and a second position, wherein in the first position each of the plurality of contact surfaces is proximate the first end relative to in the second position and in the second position each of the plurality of contact surfaces is distal from the first end relative to in the first position, wherein movement of the plunger from the first position to the second position causes ejection of cartridges accommodated within the plurality of passages from the plurality of passages, and wherein each of the plurality of passages comprises a first section extending from the first end, a second section extending from the first section, and a third section extending from the second section, the second section having a width greater than a width of the first section and a width of the third section.

2. The speed loader of claim 1, wherein each of the plurality of passages is parallel to the longitudinal axis.

3. The speed loader of claim 1, wherein the plunger further comprises a plunger body, and wherein each of the plurality of plunger arms extends from the plunger body.

4. The speed loader of claim 3, wherein the contact surface of each of the plurality of plunger arms is a distalmost surface of the plunger arm relative to the plunger body.

5. The speed loader of claim 3, wherein each of the plurality of plunger arms comprises a shaft extending from the plunger body and a head extending from the shaft, the head having a width greater than a width of the shaft.

6. The speed loader of claim 3, further comprising a grip extending from the plunger body opposite the plunger arms.

7. The speed loader of claim 1, wherein the main body is formed from an elastomer.

8. The speed loader of claim 7, wherein the elastomer has a Type A Shore hardness of between 70 and 90.

9. The speed loader of claim 1, wherein the width of the third section is greater than the width of the first section.

10. The speed loader of claim 1, further comprising a fourth section extending from the third section, the fourth section having a width greater than the width of the third section.

11. The speed loader of claim 10, wherein the fourth section extends to the second end.

12. The speed loader of claim 1, wherein the main body comprises a peripheral lip extending from the second end.

13. A speed loader for loading cartridges in a revolver cylinder, the speed loader comprising:

a main body extending along a longitudinal axis between a first end and a second end and formed from an elastomer, the main body defining a plurality of passages, each of the plurality of passages extending along the longitudinal axis between a first opening defined in the first end and a second opening defined in the second end, each of the plurality of passages comprising a first section extending from the first end, a second section extending from the first section, and a third section extending from the second section, the second section having a width greater than a width of the first section and a width of the third section; and a plunger, the plunger comprising a plunger body and a plurality of plunger arms extending from the plunger body, each of the plurality of plunger arms extendable into one of the plurality of passages and comprising a shaft extending from the plunger body and a head extending from the shaft, the head having a width greater than a width of the shaft and a width of the first section of the passage into which the plunger arm is extendable, the plunger movable along the longitudinal axis between a first position and a second position, wherein in the first position each of the plurality of heads is proximate the first end relative to in the second position and in the second position each of the plurality of heads is distal from the first end relative to in the first position.

14. The speed loader of claim 13, wherein each of the plurality of passages is parallel to the longitudinal axis.

15. The speed loader of claim 13, wherein the elastomer has a Type A Shore hardness of between 70 and 90.

16. The speed loader of claim 13, wherein the width of the third section is greater than the width of the first section.

17. The speed loader of claim 13, further comprising a fourth section extending from the third section, the fourth section having a width greater than the width of the third section.

18. The speed loader of claim 13, wherein the main body comprises a peripheral lip extending from the second end.

19. A speed loader for loading cartridges in a revolver cylinder, the speed loader comprising:

a main body configured to accommodate a plurality of cartridges therein, the main body defining a plurality of passages, each of the plurality of passages extending along the longitudinal axis between a first opening defined in the first end and a second opening defined in the second end, each of the plurality of passages comprising a first section extending from the first end, a second section extending from the first section, and a third section extending from the second section, the second section having a width greater than a width of the first section and a width of the third section; and a plunger movable along a longitudinal axis between a first position and a second position, wherein movement of the plunger from the first position to the second position causes ejection of the plurality of cartridges from the main body.

* * * * *